US006932336B1

(12) United States Patent
Nudo

(10) Patent No.: US 6,932,336 B1
(45) Date of Patent: Aug. 23, 2005

(54) CONSTRUCTION BOARD

(76) Inventor: Tim Nudo, 1520 W. Lake Shore Dr., Springfield, IL (US) 62707

( * ) Notice: Subject to any disclaimer, the term of this patent is extended or adjusted under 35 U.S.C. 154(b) by 0 days.

(21) Appl. No.: 10/790,839

(22) Filed: Mar. 3, 2004

(51) Int. Cl.[7] ..... B23Q 3/00
(52) U.S. Cl. ..... 269/302.1; 269/289 R
(58) Field of Search ..... 269/302.1, 289 R, 269/315, 303; 33/141, 429

(56) References Cited

U.S. PATENT DOCUMENTS

| | | | | |
|---|---|---|---|---|
| 1,137,482 A | | 4/1915 | Hanly | |
| 1,952,375 A | | 3/1934 | Johnson | |
| 2,369,898 A | | 2/1945 | Hoal | |
| 3,734,486 A | | 5/1973 | Peacey | |
| 3,789,507 A | * | 2/1974 | Murray, Jr. | 33/1 SD |
| 4,567,661 A | * | 2/1986 | Foose | 33/11 |
| 5,386,654 A | * | 2/1995 | Kroenke | 38/141 |
| 5,396,710 A | * | 3/1995 | Battaglia | 33/429 |
| 5,501,441 A | * | 3/1996 | Kegley | 269/289 R |
| 5,842,280 A | * | 12/1998 | Robell | 33/1 B |
| 6,460,841 B1 | * | 10/2002 | Durr | 269/289 R |

* cited by examiner

*Primary Examiner*—Lee D. Wilson

(57) ABSTRACT

A mixing and measuring tool formed of high molecular high density polyethylene enables a mason to precisely mix and provide an accurate amount of mortar to each brick saving wasted mortar. The tool presents a frictionless, hard cutting surface for cutting brick or stone. Due to the durable characteristics of the high molecular high density polyethylene, the tool surface will not absorb fluids during mixing yet withstand intense cutting or scraping without damage.

9 Claims, 3 Drawing Sheets

CONSTRUCTION BOARD

BACKGROUND OF THE INVENTION

1. Field of the Invention

The present invention relates to portable work supports, and more specifically to construction boards for handling mortar and measuring prescribed amounts for application in the field.

2. Background Information

Masonry work requires the use of a mixer, Portland cement, sand, adhesive and either brick, stone or tile. The materials are usually arranged on pallets and are gathered as the job presents itself to the mason. Depending of the set up time of the bonding material, a selected amount of bonding agent is mixed at a time and a selected amount of materials are generally laid out on the floor. The bonding materials are typically put in a bucket from the mixer prior to application.

In order to mix mortar in the field a standard ground supported mixer weighing over one hundred pounds is hauled to a site for the work. Mixers of this type are always needed in the field but provide an inefficient means for handling small amounts of bonding material. For grout, bonding adhesives and tile fillers the supplies are generally mixed in large buckets which are incompatible with the shape of a trowel when the user attempts to remove the material from the bucket. Quite often, this results in a loss of materials as they drop on the ground or harden in the corners of the container.

Masonry work is generally a sloppy job and the materials are often wasted or broken because there is no uniform dispenser as the job moves to completion. Buckets are normally filled from the top of the mixer and the excess water needs to be drained before the bonding material can be applied to the course. The brick or stone needs to be clean before the mortar is applied and sometimes needs to be cut with a saw.

Mixing boards which utilize replaceable or easy to clean mixing surfaces have been provided heretofore as illustrated in U.S. Pat. Nos. 1,137,482; 1,952,375; 2,369,898; and 3,734,486. The first patent above discloses an amalgam mixing board configured to address the problem of mercurial poisoning of a dental technician and oxidation contamination of the amalgam during its amalgamation process. Since its use in dental offices involves the mixing of very small amounts of materials immediately adjacent the patient where the amalgam is to be used, the reference construction is structurally inappropriate for the uses described above, in which materials are used in sizeable quantities, are themselves considerably heavy and bulky, and must be carried to car bodies, walls, etc., and held constantly during their application. The remaining three references disclose mixing boards of general interest.

There is a need in the field for a portable mixing and measuring tool for supporting bonding materials prior to application. There is a further need in the field for a portable support surface which assists the user in applying the bonding materials to the work. Another need in the field is a method of efficiently mixing, measuring and using bonding materials with little or no waste.

SUMMARY OF THE INVENTION

The present invention is directed to a portable masonry, mixing and measuring tool for supporting bonding materials prior to application. The tool is formed from a sheet of high molecular high density polyethylene and is provided with a frictionless surface.

It is an object of the present invention to provide a portable masonry, mixing and measuring tool for supporting brick, stone or ceramic tile during cutting.

It is another object of the present invention to provide a portable masonry, mixing and measuring tool for supporting bonding materials before application.

Another object of the present invention to provide a portable masonry, mixing and measuring tool for measuring amounts of bonding materials prior to application.

A further object of the present invention is to provide a portable masonry, mixing and measuring tool for supporting brick, stone or ceramic tile during application of bonding materials.

It is still another object of the present invention to provide a portable masonry, mixing and measuring tool which efficiently allocates a measured amount of bonding material to a measured support surface.

The present invention provides a mixing and measuring tool which enables a bricklayer to precisely mix and provide an accurate amount of mortar to each brick saving wasted mortar. The tool presents hard cutting surface for cutting brick or stone. Due to the durable characteristics of the high molecular high density polyethylene, the tool surface will not absorb fluids during mixing yet withstand intense cutting or scraping without damage.

DETAILED DESCRIPTION OF THE DRAWINGS

The present invention detailed is illustrated by way of example and not limitation in the following figures.

Figure 5:
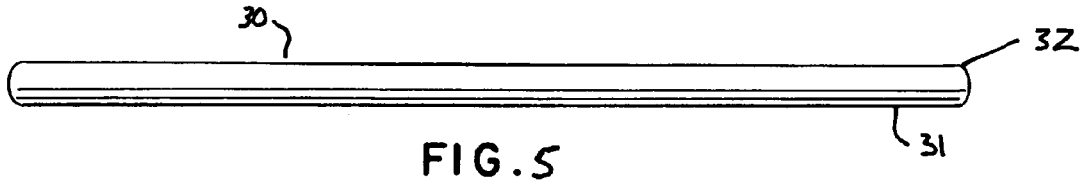

FIG. 5 a perspective view of a construction board in accordance with the teachings of the present invention.

Figure 3:
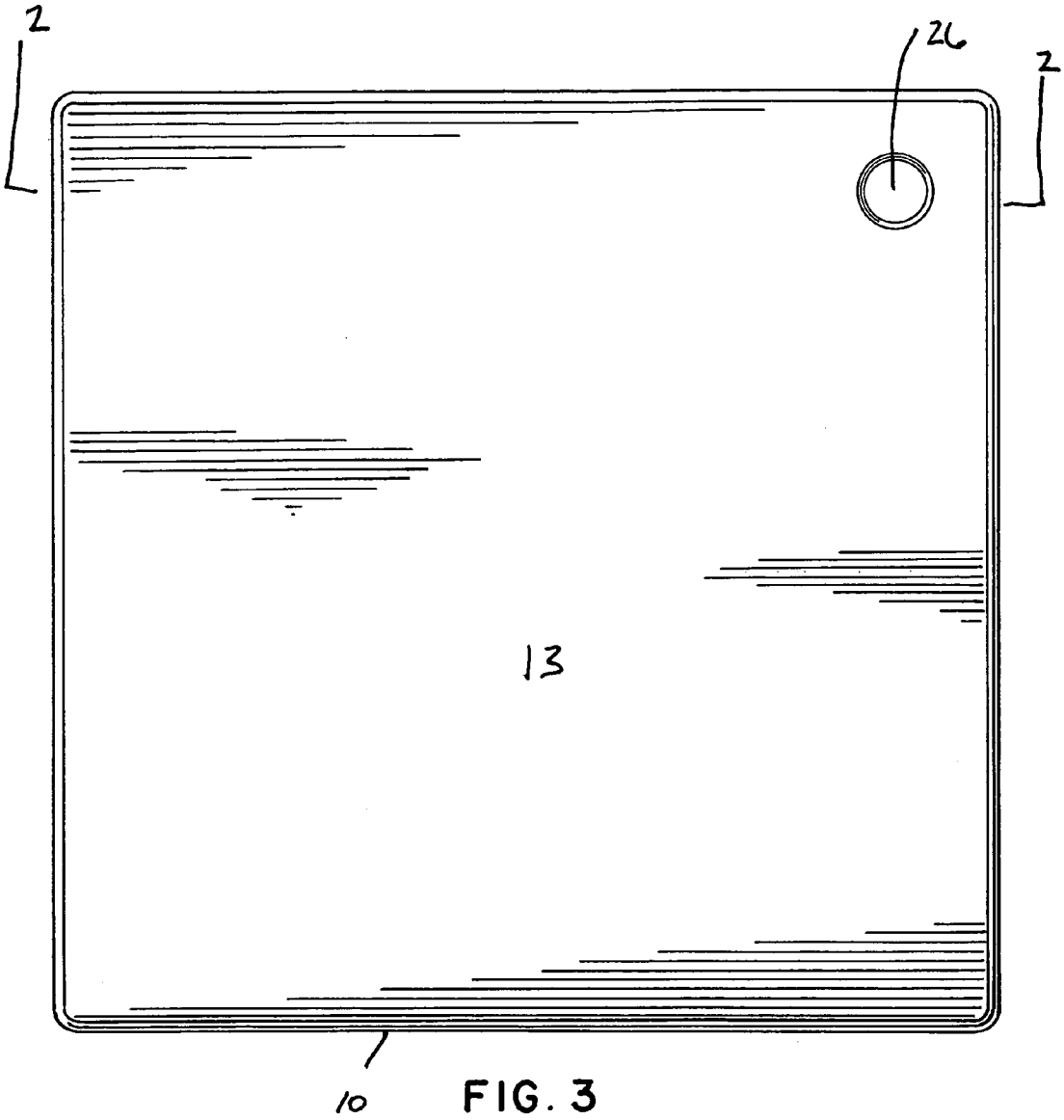
FIG. 3 is a rear view of a construction board in accordance with the teachings of the present invention.
Figure 6:
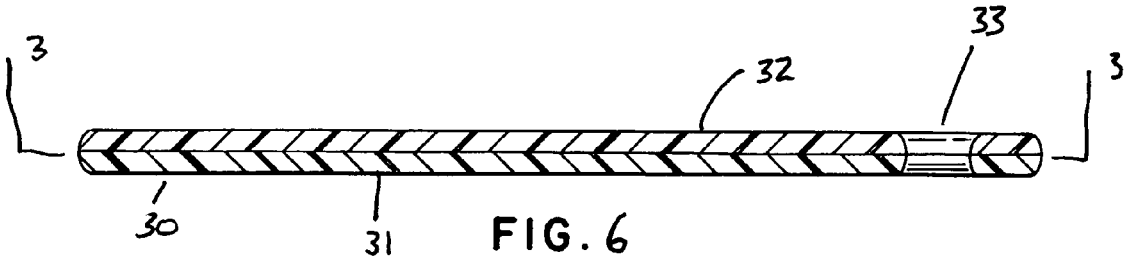

FIG. 6 is a cross sectional view taken along lines 2—2 of FIG. 3 of a construction board in accordance with the teachings of the present invention.

DESCRIPTION OF THE PREFERRED EMBODIMENTS

Embodiments of methods and apparatuses for a construction board are disclosed. In the following description, numerous specific details are set forth in order to provide a through understanding of the present invention. It will be apparent, however, to one of ordinary skill in the art that the specific detail need not be employed to practice the invention. In other instances, well-known materials or methods have not been described in detail in order to avoid obscuring the present invention.

Reference throughout this specification to "one embodiment or an embodiment means that a particular feature, structure or characteristic described in connection with the embodiment is included in at least one embodiment of the present invention. Thus, appearances of the phrases in one embodiment or in an embodiment in various places throughout the specification are not necessarily all referring to the same embodiment. Furthermore, the particular features, structures or characteristics may be combined in any suitable manner in one or more embodiments.

Figure 1:
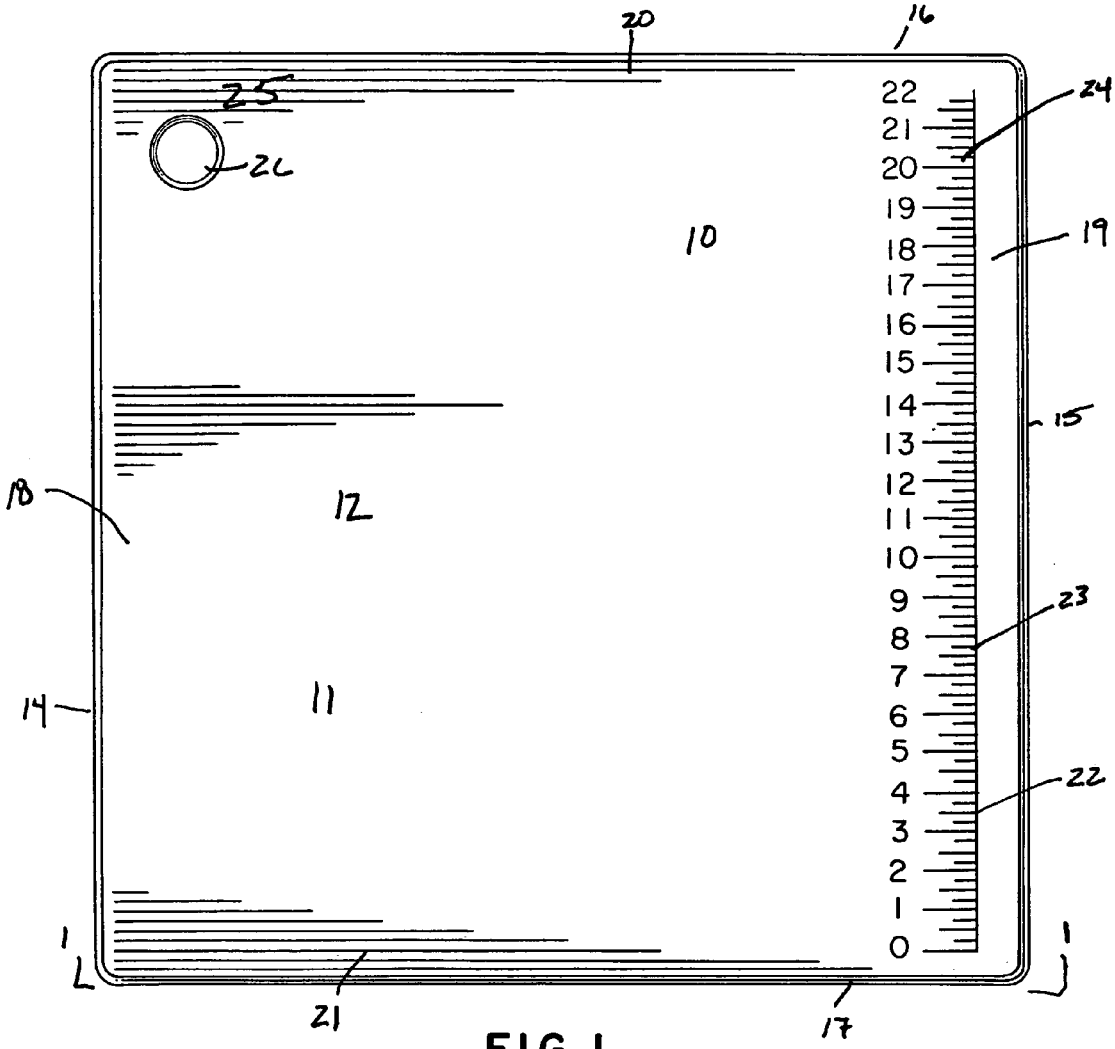
FIG. 1 is a perspective view of a construction board in accordance with the teachings of the present invention.

As an overview, embodiments of the present invention provide an improved construction board 1 for use in a variety of climates. As shown in FIG. 1, the construction board 1 has a square shape and provides a method for cutting masonry, mixing bonding materials, measuring amounts of mortar and lengths of brick. The construction board 1 also provides an efficient means for using masonry supplies in the field. The construction board further provides a means for handling smaller amounts of more workable supplies in the field.

Figure 2:
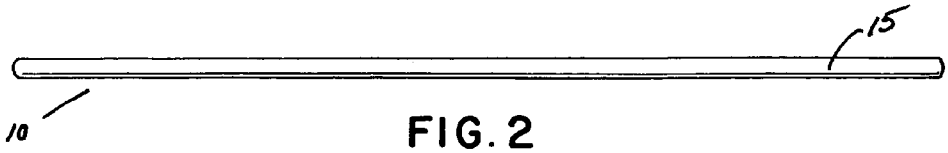
FIG. 2 is a right side surface view of a construction board in accordance with the teachings of the present invention.

The construction board 1 includes a tool 10 formed from a sheet 11 of high molecular high density polyethylene. Depending on the type of masonry, the sheet 11 is formed to a thickness of less than two inches, a width of less than two feet and a height of less than four feet. FIG. 2 depicts an edge view of the construction board 1 taken along lines 1—1 of FIG. 1. In the preferred embodiment, the sheet 11 has a thickness of approximately one half inch, a width of 21 inches and a height of 21 inches. The shape of the sheet may be rectangular, square, triangular or circular.

The use of high molecular weight high density polyethylene provides a strong impact resistant surface for cutting brick or stone or for mixing bonding materials. The high molecular weight polyethylene (HMWPE) could be an ultra-high molecular weight polyethylene having a viscosity-based molecular weight (M.sub.0) of from approximately 250,000 to 450,000. In the preferred embodiment, the polyethylene is a high molecular weight polyethylene (HMWPE) such as a 5100 series high molecular weight polyethylene available from various suppliers such as General Electric, sold under the trade name "HMWPE 5100". Other polyethylenes are also available under the trade names PAXON BASO-100 from Allied and MARLEX HXM 50100 from Phillips. Other polyethylene resins can be used, such as the DuPont ELTREX B5920 high density polyethylene. The board can further include a hydrophobic ingredient.

As illustrated in FIG. 1, the tool 10 has has a top surface 12, a bottom surface 13 (shown in FIG. 3), a left side surface 14, a right side surface 15, a front side surface 16 a rear side surface 17, a left edge surface 18, a right side surface 19, a front edge surface 20, and a rear edge surface 21. The top surface 12 is formed by shaving the sheet 11 to a planar frictionless working area. The hydrophobic ingredient provided in the formulation of the board adds lubricity to the shaved surface formation. Moreover, due to the durable characteristics of the high molecular high density polyethylene, the tool surface will not absorb fluids during mixing yet withstand intense cutting or scraping without damage.

Formed in the right edge surface 19 of the tool 10 is a scale means 22 for measuring selected amounts of bonding materials and for measuring brick or stones prior to cutting or bonding. The scale means 21 includes a ruler 23 having indicia 24 depicting 22 inches with quarter and half inch markings. In the preferred embodiment the ruler 23 is routed into the top surface 12. The ruler 24 may extend along the edge surfaces 18–21 completely around the perimeter to provide a square. Alternatively, the ruler may be formed on the surface 12 by printing or embossing.

Figure 4:
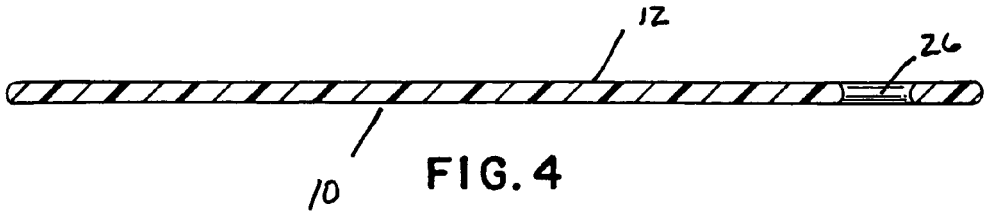
FIG. 4 is a cross sectional view taken along lines 2—2 of FIG. 3 of a construction board in accordance with the teachings of the present invention.

As shown in FIG. 4, top left corner 25 of the construction board 1 is provided with a handle 26. The handle 26 is integrally formed with the construction board. The handle 26 extends completely through the construction board 1 as shown in FIG. 4. The handle 26 further serves as a drain during mixing or for cut debris.

An embodiment shown in FIGS. 5 and 6 illustrates a tool 30 formed essentially as described in the previous embodiment but with a bottom support layer 31. The bottom support layer 31 has substantially the same thickness as sheet 32. The bottom layer 31 is made of material which will not warp in cold weather and is bonded to sheet 11 by an adhesive. The bottom layer 31 further prevents the sheet 11 from warping in freezing temperatures. The bottom layer 31 may be made of temperature resistant plastic, wood, steel, aluminum, or gypsum. A handle is shown as 33.

The construction board 1 may be supported on a pair of saw horses or on a table in the field. Bonding materials can be mixed in a mixer or on the top surface 12 of the board. Due the shaved frictionless surface, a trowel can accurately work the bonding materials and align a measured amount by sliding a portion of the bonding materials to the ruler 24. A brick or a stone can then be placed on the ruler 24 to correspond to the measured amount of material. Thus, the tool 10 enables a mason to precisely provide an accurate amount of mortar to the brick saving wasted mortar. The hard surface of the board further provides a hard cutting surface for cutting brick or stone. The durable characteristics of the HDPE the board surface will not absorb fluids yet withstand cutting or scraping without damage.

What is claimed is:

1. A portable masonry, mixing and measuring tool for supporting bonding materials prior to application, said tool comprising:

a sheet of high molecular high density polyethylene, said sheet having a thickness of less than two inches, a width of less than two feet and a height of less than four feet, a stabilizing bottom support layer made of temperature resistant plastic bonded to said sheet, and, an integrally formed scale routed in said sheet for measuring selected amounts of bonding materials.

2. The potable masonry, mixing and measuring tool as recited in claim 1, said tool further comprising an integrally formed handle.

3. The portable masonry, mixing and measuring tool as recited in claim 1, said tool further comprising a square integrally formed in said tool.

4. A portable masonry, mixing and measuring tool for supporting bonding materials prior to application, said tool comprising:

a sheet of high molecular high density polyethylene, said sheet having a thickness of less than two inches, a width of less than two feet and a height of less than four feet, said sheet having a mixing surface, said mixing surface having a top edge, a right edge, a left edge, and a bottom edge, a stabilizing bottom support layer made of temperature resistant plastic, and a scale, said scale provided on said mixing surface for measuring selected amounts of bonding materials.

5. The portable masonry, mixing and measuring tool as recited in claim 4, said tool further comprising an integrally formed handle.

6. The portable masonry, mixing and measuring tool as recited in claim 4, said tool further comprising a square integrally formed in said tool.

7. A portable masonry, mixing and measuring tool for supporting bonding materials prior to application, said tool comprising:

a sheet of high molecular high density polyethylene, said sheet having a thickness of less than two inches, a width of less than two feet and a height of less than four feet, said sheet having a mixing surface, said mixing surface having a top edge, a right edge, a left edge, and a bottom edge, and a stabilizing bottom support layer made of aluminum bonded to said sheet.

8. The portable masonry, mixing and measuring tool as recited in claim 7, said tool further comprising a square integrally formed in said top support layers.

9. The portable masonry, mixing and measuring tool as recited in claim 7, said tool further comprising an integrally formed handle.

* * * * *